United States Patent [19]

Urion et al.

[11] 4,095,636

[45] Jun. 20, 1978

[54] BOWLING BALL BAG AND FRAME

[75] Inventors: Kenard Emerson Urion, Dover; John Harrison Tyre, Smyrna, both of Del.

[73] Assignee: Leeds Travelwear, a division of Rapid-American Corporation, Clayton, Del.

[21] Appl. No.: 769,877

[22] Filed: Feb. 18, 1977

[51] Int. Cl.[2] ..... A45C 11/00

[52] U.S. Cl. ..... 150/52 A; 206/315 B; 211/14

[58] Field of Search ..... 150/52 A; 206/315 B; 211/14; 224/45 L, 47

[56] References Cited

U.S. PATENT DOCUMENTS

| | | | |
|---|---|---|---|
| 2,844,258 | 7/1958 | Faber | 211/14 |
| 3,079,967 | 3/1963 | Noel | 150/52 A |
| 3,355,027 | 11/1967 | Gibbons | 211/14 |
| 3,690,360 | 9/1972 | Cahill | 150/52 A |
| 3,918,618 | 11/1975 | Castaneda | 224/45 L |

*Primary Examiner*—Donald F. Norton

*Attorney, Agent, or Firm*—Ostrolenk, Faber, Gerb & Soffen

[57] ABSTRACT

A soft-sided bowling ball carrying bag having a supporting frame for the bowling ball wherein an additional loop of the frame extends upwardly to the top of the bag and over the center of gravity of the bowling ball to provide an anchor and positioning means for a single handle which is positioned and centered with respect to the bowling ball.

8 Claims, 7 Drawing Figures

FIG. 1.
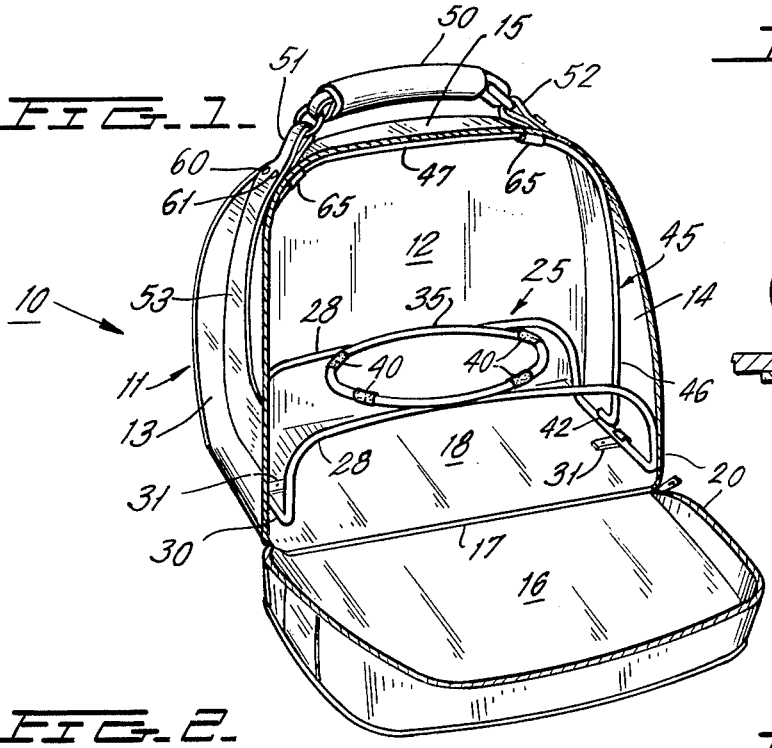
FIG. 4.
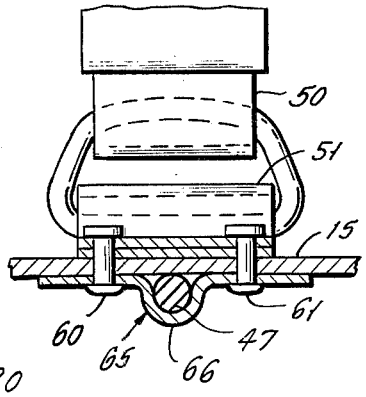
FIG. 2.
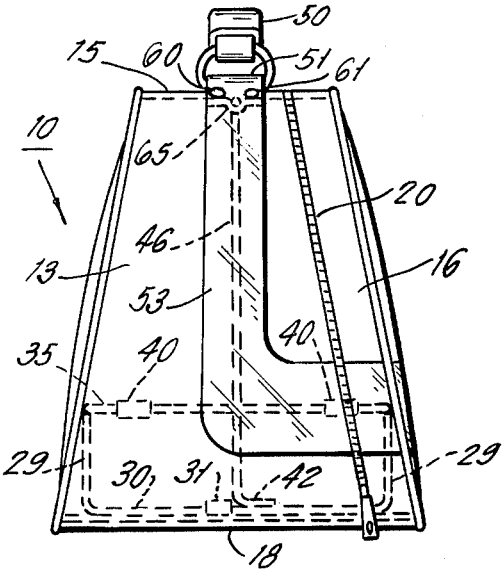
FIG. 3.
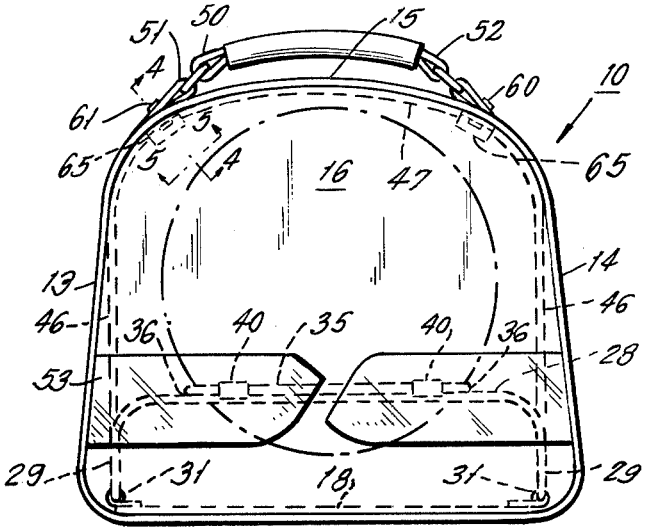
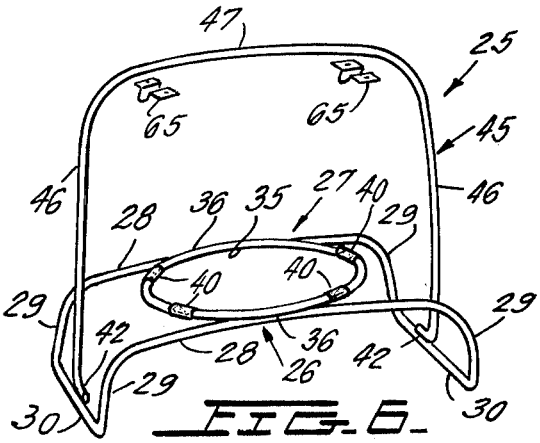
FIG. 6.
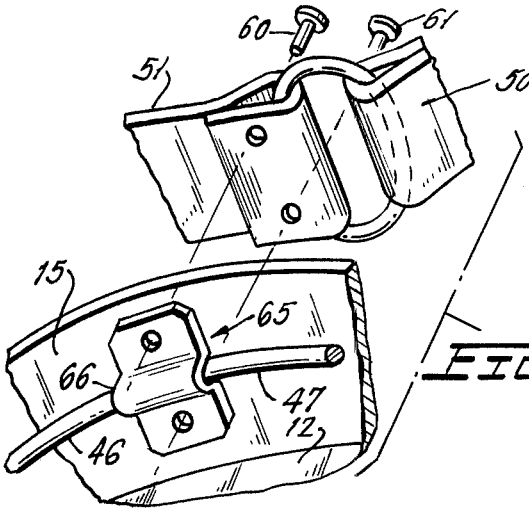
FIG. 5.

BOWLING BALL BAG AND FRAME

The present invention relates to a bag for a bowling ball and more particularly to one in which a single handle may conveniently be used at the top of the bowling bag, in place of the two handles which were previously thought to be required in bowling bags. A frame is placed inside the bowling bag to support the bowling ball clear of the bottom and thereby provides carrying or storage space beneath the bowling ball, but the frame is continued up and around the top of the inside of the bag to form a continuous supporting loop for the frame at the central longitudinal axis of the bag. Thus, the fastening of the single handle through the top of the bag to the supporting loop provides a centralized firm support for the bag while the bowling bag is positioned by the frame and contained by the bag itself.

Heretofore in the construction and operation of bags for bowling balls, whether or not they were provided with additional compartments for bowling shoes or other material, the usual custom has been to provide some kind of positioning means to keep the bowling ball from rolling in the bag itself or to shape the bag so that a portion of it completely encases the bowling ball. There have been soft-sided and molded or plastic bags. In the case of the soft-sided bag, it has almost invariably been found necessary to provide two straps on either side of the bag so that the possibly shifting weight of the bowling ball will be evenly supported. Where the bowling bag has been molded to the shape of the ball, it may be possible to utilize a single strap, but then of course, the ball is completely surrounded and encased by the shaped and molded bag.

The object of the present invention is to make it possible to utilize a single handle in a soft-sided bowling bag by providing a frame for support and positioning of the bowling ball within the bowling bag, the frame supporting and positioning the bowling ball above the bottom of the bowling bag and having a loop extending upwardly; the top portion of the loop extends parallel to the handle of the bowling bag and the handle of the bowling bag is attached through the top of the bowling bag to the said upward loop of the frame.

A further and consequent object of the present invention is thereby to provide a balanced support for a bowling bag in which a single handle is perfectly centered over the center of gravity of the bowling ball, while the bowling ball is itself supported within the bowling bag by a frame which is able to take and distribute the weight of the bowling ball.

The foregoing and other objects of the invention will become apparent in the following description and drawings in which FIG. 1 is a view in perspective of the novel bowling bag of the present invention opened.

FIG. 2 is an end-view, of the bowling bag of FIG. 1 closed, showing the frame in position and the location and relationship of the frame and handle.

FIG. 3 is a side-view of the bowling bag of FIGS. 1 and 2 also showing the frame and the bowling ball in position.

FIG. 4 is a cross-sectional view taken from line 4—4 of FIG. 3, looking in the direction of the arrows showing the method of securing the handle to the frame.

FIG. 5 is a partly exploded view of the handle securing means, taken from line 5—5 of FIG. 3, looking in the direction of the arrows.

FIG. 6 is a view in perspective of the frame of the bowling bag of FIG. 1.

Figure 7:
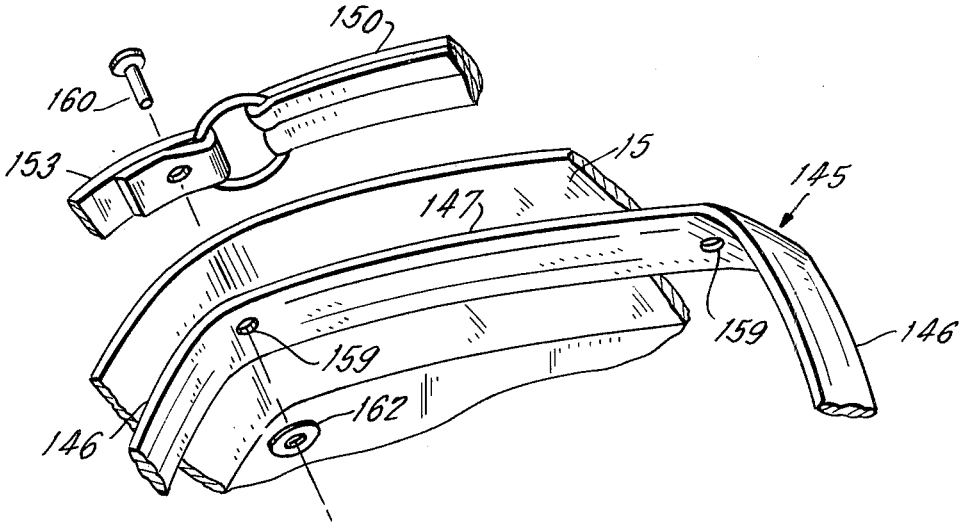
FIG. 7 is a fragmentary view in perspective of a modified form of the frame of FIG. 7.

Referring first to FIGS. 1, 2, 3 and 4, the bowling bag 10 has a main section 11, having a side wall 12, an end wall 13, an opposite end wall 14, a top wall 15 and a bottom wall 18. A cover 16, hingedly secured in any suitable manner, as by a fold of material at the hinged connection 17 to the bottom wall 18 may be closed and secured to the open edges of the end walls 13, 14 and the top wall 15 in any suitable manner as by the zipper closing 20.

A frame 25 (see also the perspective view of FIG. 6) may be secured in the bowling bag 10 and to the bottom wall 18 thereof. The frame 25 consists of two arched members 26 and 27, each having a substantially horizontal run 28,28, and a pair of vertical legs 29,29 extending downwardly from each horizontal run 28,28. The legs 29,29 are inter-connected, preferably by the integral cross-bars 30,30.

The integral cross-bars 30,30 may be secured to the bottom 18 of the bag by clips 31,31 riveted to the bottom of the bag at each end and having a section engaging the cross-bars 30. These cross-bars 30 rest on the bottom of the bag and support the frame and the bowling ball which is to be carried thereby.

The bowling ball is positioned in the frame 25 by the circular receptacle 35 which is secured in any suitable manner as by welding at 36,36 to the horizontal runs 28,28 of the frame 27. The receptacle 35 may be provided in any suitable manner with cushioning means to prevent marring of the ball, as for instance, by sleeves 40,40 of rubber or rubber-substitute, or rubber soft material.

The horizontal members 30 are secured thereto in any suitable manner as by welding, to bent-over extensions 42,42 of the carrying loop 45. The carrying loop 45 is provided with two central vertical risers 46,46 integral with the extensions 42,42 and inter-connected by the top carrying section 47 of the carrying loop 45. When the frame 25 of FIG. 6 is now secured to the bottom of the bag 18 the handle may be secured to the top section 47 of loop 45 through the outside of the bag as seen more specifically in FIG. 4 and 5 as well as in the other Figures.

The handle 50 is connected to the flexible tabs 51, 52 in the manner well known in connection with handles. The flexible tabs 51,52 may be ornamental and constitute an extension of an additional strap or layer of material 53 on each side of the bag which is sewn down to the bag to insure interconnection of the bag with the handle.

The tabs 51,52 which are actually extensions of the securing bands 53 are further secured to the bowling bag by rivets 60,61 which pass through openings in the tabs 51,52 as seen particularly in FIGS. 4 and 5 and through the top of the bag 15 and into the retaining clip 65 on each side. The retaining clip is provided with a shaped recess 66 to receive the loop sections 46–47 on the other side. In this way, the handle structure is integrated completely with the frame, is centralized with respect to the frame and thus furnishes a direct support above the center of gravity of the bowling ball for the bowling ball and the frame. At the same time, because the straps 53,51 and 53,52 are secured to the side of the bag, the handle 50 is also integrated with the bag 10 as well.

In FIG. 7 there is shown a modified form of the frame of FIGS. 1 to 6 in which, essentially, all the elements of the frame are the same; but at least part of the legs 146 and top section 47 of loop 145 is flattened for further rigidify the bag and provide a support for the handle. The flattened sections between legs 146 on each side and loop 147 are provided with openings 159,159 through which the rivet or other fastener 160 may pass and be engaged by washer or other securing devices 162. In this way, instead of using the clips of FIG. 5, the rivet or fastener 160 of FIG. 7 would pass through the band 153 which supports handle 150, through the material of the bag to the interior of the bag, and through the frame itself to provide the bag support.

By this means, therefor, the handle is absolutely oriented with respect to the bowling ball carrying frame so that only a single handle need be used to carry the bowling bag while nevertheless making certain that this handle will at all times be above the center of gravity of the ball and thus will support the ball appropriately.

In the foregoing, the present invention has been described in connection with an illustrative embodiment thereof.

Since many variations and modifications of the present invention will now be obvious to those skilled in the art, it is preferred that the scope of this invention be defined not by the specific description herein contained, but only by the appended claims.

What is claimed is:

1. A frame for a bowling ball bag comprising a lower frame section having a pair of parallel longitudinal members carrying at least one circular horizontal member between them, said circular horizontal member having a diameter less than a bowling ball and being adapted to receive and position a bowling ball; said longitudinal members each having legs extending downwardly by a distance greater than the depth to which a bowling ball may extend downwardly into said circular horizontal member;

said frame having a central vertical loop extending above said longitudinal members, said central vertical loop having a section overlying the center of said circular horizontal member and hence the center of gravity of any ball which may be carried thereby;

the legs at each end of said longitudinal members being interconnected at their bottom ends by a cross bar;

said central vertical loop has a pair of legs extending downward from said section thereof overlying the center of said circular horizontal member; each of said legs of said loop being connected to a cross-bar on each side.

2. The frame for the bowling ball bag of claim 1 wherein a bag is provided; said frame being mounted in said bag;

said bag having a handle at the top;

said handle being secured through the top of said bag to said section of said central vertical loop overlying said circular horizontal member.

3. The frame for the bowling ball bag of claim 2 wherein the means for securing said handle includes a clip inside the bag underlying each end of said handle and each clip encasing a portion of said vertical loop; and means for inter-engaging each end of said handle with a clip.

4. The frame for the bowling ball bag of claim 2 wherein said bag has a bottom wall; said cross bars being secured to said bottom wall.

5. The frame for the bowling ball bag of claim 4 wherein the means for securing said handle includes a clip inside the bag underlying each end of said handle and each encasing a portion of said vertical loop; and means for inter-engaging each end of said handle with a clip.

6. A frame for a bowling ball bag comprising a lower frame section having a pair of parallel longitudinal members carrying at least one circular horizontal member between them, said circular horizontal member having a diameter less than a bowling ball and being adapted to receive and position a bowling ball; said longitudinal members each having legs extending downwardly by a distance greater than the depth to which a bowling ball may extend downwardly into said circular horizontal member;

said frame having a central vertical loop extending above said longitudinal members, said central vertical loop having a section overlying the center of said circular horizontal member and hence the center of gravity of any ball which may be carried thereby;

a bag being provided; said frame being mounted in said bag;

said bag having a handle at the top;

said handle being secured through the top of said bag to said section of said central vertical loop overlying said circular horizontal member.

7. The frame and bowling ball bag of claim 6 wherein the means for securing said handle through the top of said bag comprises a fastener; said frame having means for receiving said fastener; an extension from said handle; said fastener engaging said extension from said handle, passing through said bag and into engagement with the said means for receiving said fastener.

8. The frame and bowling ball bag of claim 7 wherein said means for receiving said fastener includes an opening in said frame.

* * * * *